US007360608B2

(12) United States Patent
Brackin et al.

(10) Patent No.: US 7,360,608 B2
(45) Date of Patent: Apr. 22, 2008

(54) ROTARY DRILL BITS INCLUDING AT LEAST ONE SUBSTANTIALLY HELICALLY EXTENDING FEATURE AND METHODS OF OPERATION

(75) Inventors: Van J. Brackin, Conroe, TX (US); Brian E. Miller, The Woodlands, TX (US); Mathews George, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 259 days.

(21) Appl. No.: 10/938,424

(22) Filed: Sep. 9, 2004

(65) Prior Publication Data

US 2006/0048973 A1 Mar. 9, 2006

(51) Int. Cl.
*E21B 10/46* (2006.01)
*E21B 10/42* (2006.01)

(52) U.S. Cl. ..... 175/57; 175/431; 175/432

(58) Field of Classification Search ..... 175/57, 175/426, 431, 432, 323, 377, 395, 408, 430, 175/394

See application file for complete search history.

(56) References Cited

U.S. PATENT DOCUMENTS 1,084,871 A * 1/1914 Tuck ..... 299/87.1
1,805,678 A 5/1931 Smith
2,198,849 A 4/1940 Waxler
2,563,515 A 8/1951 Brown
2,624,549 A 1/1953 Wallace
2,684,835 A 7/1954 Moore
2,776,617 A 1/1957 Gregory et al.
3,153,458 A 10/1964 Short
3,303,694 A 2/1967 Varney
3,709,308 A 1/1973 Rowley et al.
3,779,323 A 12/1973 Horten et al.

(Continued)

FOREIGN PATENT DOCUMENTS

EP 0 605 151 A1 12/1993

(Continued)

OTHER PUBLICATIONS

EPO Search Report prepared for the Belgian Patent Office, dated Jun. 20, 2006.

(Continued)

*Primary Examiner*—Jennifer H. Gay
*Assistant Examiner*—David Andrews
(74) *Attorney, Agent, or Firm*—TraskBritt

(57) ABSTRACT

A rotary drill bit is disclosed, including at least one cutting element affixed thereto and configured to form a distinct borehole surface in response to drilling a subterranean formation. At least one substantially helically extending feature associated with the at least one cutting element may be formed upon the leading end of the rotary drill bit. Alternatively, a rotary drill bit may include a plurality of substantially helically extending features. Methods of operating a rotary drill bit are also disclosed. Specifically, a subterranean formation may be drilled with a rotary drill bit to form an on-center bottomhole pattern, which may be at least partially contacted by at least one substantially helically extending feature of the rotary drill bit. Alternatively, a subterranean formation may be contacted with at least one substantially helically extending feature of the rotary drill bit. A method of designing a rotary drill bit is disclosed.

40 Claims, 7 Drawing Sheets

U.S. PATENT DOCUMENTS 4,351,401 A 9/1982 Fielder
4,386,669 A 6/1983 Evans
4,397,363 A * 8/1983 Fuller ..... 175/428
4,492,277 A 1/1985 Creighton
4,499,958 A 2/1985 Radtke et al.
4,554,986 A 11/1985 Jones
4,718,505 A 1/1988 Fuller
4,763,737 A 8/1988 Helnick
4,823,892 A 4/1989 Fuller
4,848,489 A 7/1989 Deane
4,889,017 A 12/1989 Fuller et al.
4,942,933 A 7/1990 Barr et al.
4,981,184 A 1/1991 Knowlton et al.
4,982,802 A 1/1991 Warren et al.
4,991,670 A 2/1991 Fuller et al.
5,010,789 A 4/1991 Brett et al.
5,042,596 A 8/1991 Brett et al.
5,090,492 A 2/1992 Keith
5,111,892 A 5/1992 Sinor et al.
5,131,478 A 7/1992 Brett et al.
5,186,268 A 2/1993 Clegg
5,199,511 A 4/1993 Tibbitts et al.
5,222,566 A 6/1993 Taylor et al.
5,244,039 A 9/1993 Newton, Jr. et al.
5,265,685 A 11/1993 Keith et al.
5,287,936 A 2/1994 Grimes et al.
5,303,785 A 4/1994 Duke
5,314,033 A 5/1994 Tibbitts
5,346,026 A 9/1994 Pessier et al.
5,388,649 A 2/1995 Ilomaki
5,402,856 A 4/1995 Warren et al.
5,435,403 A 7/1995 Tibbitts
5,460,233 A 10/1995 Meany et al.
5,467,836 A 11/1995 Grimes et al.
5,492,186 A 2/1996 Overstreet et al.
5,531,281 A 7/1996 Murdock
5,558,170 A 9/1996 Thigpen et al.
5,595,252 A 1/1997 O'Hanlon
5,655,612 A 8/1997 Grimes et al.
5,663,512 A 9/1997 Schader et al.
5,706,906 A 1/1998 Jurewicz et al.
5,730,234 A 3/1998 Putot
5,957,227 A 9/1999 Besson et al.
5,967,249 A * 10/1999 Butcher ..... 175/428
5,979,577 A 11/1999 Fielder
6,000,483 A 12/1999 Jurewicz et al.
6,003,623 A 12/1999 Miess
6,039,131 A 3/2000 Beaton
6,050,354 A 4/2000 Pessier et al.
6,123,161 A 9/2000 Taylor
6,283,233 B1 9/2001 Lamine et al.
6,298,930 B1 10/2001 Sinor et al.
6,460,631 B2 10/2002 Dykstra
6,575,256 B1 6/2003 Doster
6,615,934 B2 * 9/2003 Mensa-Wilmot ..... 175/327
6,651,756 B1 11/2003 Costo, Jr. et al.
6,659,199 B2 12/2003 Swadi

FOREIGN PATENT DOCUMENTS

EP 1 236 861 A1 9/2002

OTHER PUBLICATIONS

Great Britain Search Report dated Dec. 8, 2005.
1995 Hughes Christensen 1995 Drill Bit Catalog, p. 31.
Hughes Christensen Bit Drawing dated May 29, 1997—HC Part No. CC201918.
Hughes Christensen Bit Drawing dated Sep. 18, 1996—HC Part No. CW210655.
Hughes Christensen Bit Drawing dated Sep. 18, 1996—HC Part No. CS205023.
Hughes Christensen Bit Drawing dated Sep. 9, 1996—HC Part No. CC201718.
International Search Report dated Sep. 6, 2002.

* cited by examiner

ROTARY DRILL BITS INCLUDING AT LEAST ONE SUBSTANTIALLY HELICALLY EXTENDING FEATURE AND METHODS OF OPERATION

BACKGROUND OF THE INVENTION

1. Field of the Invention

The present invention relates to rotary drill bits and their operation and, more specifically, to the design of such rotary drill bits for optimum performance in the context of controlling or maintaining stability (e.g., reducing vibration) during use.

2. Background of Related Art

Rotary drill bits employing cutting elements such as polycrystalline diamond compact (PDC) cutters have been employed for several decades. PDC cutters are typically comprised of a disc-shaped diamond table formed on and bonded (under ultra-high pressure, ultra-high temperature conditions) to a supporting substrate such as a substrate comprising cemented tungsten carbide (WC), although other configurations are known in the art. Rotary drill bits carrying PDC cutters, also known as so-called "fixed cutter" drag bits, have proven very effective in achieving high rates of penetration (ROP) in drilling subterranean formations exhibiting low to medium compressive strengths. Improvements in stability of rotary drill bits, based on cutting element design, cutting element placement, and cutting element force analysis, have reduced prior, notable tendencies of such bits to vibrate in a deleterious manner, also known as "whirling."

For instance, so-called "anti-whirl" drilling structures are disclosed in U.S. Pat. No. 5,402,856 to Warren, et al., asserting that a bearing surface aligned with a resultant radial force generated by an anti-whirl under-reamer should be sized so that force per area applied to the borehole sidewall will not exceed the compressive strength of the formation being under-reamed. See also U.S. Pat. No. 4,982,802 to Warren et al., U.S. Pat. No. 5,010,789 to Brett et al., U.S. Pat. No. 5,042,596 to Brett et al., U.S. Pat. No. 5,111,892 to Sinor et al. and U.S. Pat. No. 5,131,478 to Brett et al.

Even in view of such improvements, however, cutting elements, particularly PDC cutters, may still suffer generally from overloading due to a relatively large depth of cut or rotary drill bit instability. For example, drilling into low compressive strength subterranean formations may allow an unduly great depth of cut (DOC) to be achieved at extremely low weight-on-bit (WOB). Further, cutting element damage may occur if a harder subterranean formation is encountered or hard pockets or structures known as "stringers" are suddenly encountered by the rotary drill bit traveling at an unduly great DOC. The problem may also be aggravated by so-called "string bounce," wherein the elasticity of the drill string may cause erratic application of WOB to the drill bit, with consequent overloading. Moreover, operating PDC cutters at an excessively high DOC may generate more formation cuttings than can be consistently cleared from the bit face and through the junk slots, leading to bit balling, as known in the art.

Another, separate problem involves drilling from a zone or stratum of higher formation compressive strength to a zone of lower strength. As the bit drills into the softer formation without changing the applied WOB (or before the WOB can be changed by the directional driller), the penetration of the PDC cutters, and thus the resulting torque on the bit, increase almost instantaneously and by a substantial magnitude. The abruptly higher torque, in turn, may cause damage to the cutters. In directional drilling, such a change may cause the tool face orientation of the directional (measuring while drilling, or MWD, or a steering tool) assembly to fluctuate, making it more difficult for a directional driller to follow a planned directional path for the bit and necessitating resetting the tool face. In addition, a downhole motor, such as the drilling fluid-driven Moineau motors commonly employed in directional drilling operations in combination with a steerable bottomhole assembly, may completely stall under a sudden torque increase, stopping the drilling operation and again necessitating reestablishing drilling fluid flow and motor output.

Numerous attempts utilizing varying approaches have been made over the years to protect the integrity of a cutting element such as a PDC cutter and its mounting structure, and to limit cutting element penetration into a formation being drilled. For example, from a period even before the advent of commercial use of PDC cutters, U.S. Pat. No. 3,709,308 to Rowley et al. discloses the use of trailing, round natural diamonds on the bit body to limit the penetration of cubic diamonds employed to cut a formation. U.S. Pat. No. 4,351,401 to Fielder discloses the use of surface set natural diamonds at or near the gage of the bit as penetration limiters to control the depth of cut of PDC cutters on the bit face. Other patents disclose the use of a variety of structures immediately trailing PDC cutters (with respect to the direction of bit rotation) to protect the cutters or their mounting structures: U.S. Pat. No. 4,889,017 to Fuller et al., U.S. Pat. No. 4,991,670 to Fuller et al., U.S. Pat. No. 5,244,039 to Newton, Jr., et al., and U.S. Pat. No. 5,303,785 to Kuke. In addition, U.S. Pat. No. 5,314,033 to Tibbitts, assigned to the assignee of the present invention, discloses, inter alia, the use of cooperating positive and negative or neutral back rake cutters to limit penetration of the positive rake cutters into the formation. Another approach to limiting cutting element penetration is to employ structures or features on the bit body rotationally preceding (rather than trailing) PDC cutters, as disclosed in U.S. Pat. No. 3,153,458 to Short, U.S. Pat. No. 4,554,986 to Jones, U.S. Pat. No. 5,199,511 to Tibbitts et al., and U.S. Pat. No. 5,595,252 to O'Hanlon.

U.S. Pat. No. 6,298,930 to Sinor et al. and U.S. Pat. No. 6,460,631 to Dykstra et al., assigned to the assignee of the present invention and the disclosures of each of which are incorporated, in their entireties by reference herein, respectively relate to bit designs including depth of cut control (DOCC) features which may rotationally lead at least some of the PDC cutters on the bit face on which the bit may ride while the PDC cutters of the bit are engaged with the formation to their design DOC. Stated another way, the cutter standoff or exposure may be substantially controlled by the DOCC features, and such control may enable a relatively greater DOC (and thus ROP for a given bit rotational speed) than with a conventional bit design. Particularly, the DOCC features may preclude a greater DOC than that designed for by distributing the load attributable to WOB over a sufficient surface area on the bit face, blades or other bit body structure contacting the uncut formation face at the borehole bottom so that the compressive strength of the formation will not be exceeded by the DOCC features. As a result, the bit does not substantially indent, or fail, the formation rock and permits greater than intended cutter penetration and consequent increase in cutter loading and torque.

U.S. Pat. No. 6,659,199 to Swadi, assigned to the assignee of the present invention and the disclosure of which is incorporated in its entirety by reference herein, relates to a rotary drag bit carrying PDC cutters and elongated bearing elements associated with at least some of the PDC cutters on the bit face thereof. Lateral positioning and angular positioning of the elongated bearing elements are adjusted so that all portions of an elongated bearing element travel substantially completely within a tubular clearance volume defined by the path through the formation being drilled by a PDC cutter with which that elongated bearing element is associated, the associated PDC cutter being positioned at about the same radius from the bit centerline as the elongated bearing element.

While some of the foregoing patents recognize the desirability to limit cutter penetration or DOC, other patents emphasize stability approaches for limiting forces applied to cutting elements carried by a rotary drill bit, the disclosed approaches are somewhat isolated in nature and fail to accommodate or implement an engineered approach to achieving both improved stability and limiting the penetration rate or DOC.

SUMMARY OF THE INVENTION

The present invention relates to a rotary drill bit for subterranean drilling. More particularly, a rotary drill bit of the present invention may include a bit body having a leading end for contacting a formation during drilling and a trailing end having a connection structure associated therewith for connecting the rotary drill bit to a drill string. At least one cutting element may be affixed to the leading end of the rotary drill bit and may be configured to form a distinct borehole surface in response to drilling engagement with a subterranean formation. Also, at least one substantially helically extending feature may be formed upon the leading end associated with the at least one cutting element and rotationally following the at least one cutting element. The at least one substantially helically extending feature may be structured for contacting at least a portion of the distinct borehole surface generated by the at least one cutting element while engaging a subterranean formation along a predetermined, selected helical path. Alternatively, in another embodiment of the present invention, a rotary drill bit may include a plurality of substantially helically extending features.

Another aspect of the present invention relates to a method of operating a rotary drill bit for subterranean drilling. Specifically, a rotary drill bit may be provided having at least one cutting element, a longitudinal axis, and at least one substantially helically extending feature associated with the at least one cutting element. Further, a subterranean formation may be drilled with the rotary drill bit to form a borehole having an on-center bottomhole pattern within the subterranean formation. Also, the on-center bottomhole pattern may be at least partially contacted by the at least one substantially helically extending feature in response to a lateral deviation of the longitudinal axis of the rotary drill bit.

Yet a further aspect of the present invention relates to a method of operating a rotary drill bit for subterranean drilling. In particular, a rotary drill bit may be provided having a longitudinal axis and at least one substantially helically extending feature having a selected Helical Pitch. Additionally, a subterranean formation may be drilled into with the rotary drill bit to form a borehole within the subterranean formation and the subterranean formation may be contacted with the at least one substantially helically extending feature in response to the rotary drill bit exhibiting substantially the selected Helical Pitch.

It should also be understood that the advantages of the present invention relate to a method of designing a rotary drill bit for subterranean drilling. In accordance with the present invention, a plurality of cutting elements may be selected and positioned upon the rotary drill bit under design for drilling a borehole. Further, at least one substantially helically extending feature rotationally following and associated with at least one of the plurality of cutting elements may be selected, respectively. In addition, the at least one substantially helically extending feature may exhibit a selected maximum Helical Pitch.

BRIEF DESCRIPTION OF THE SEVERAL VIEWS OF THE DRAWINGS

The foregoing and other advantages of the present invention will become apparent upon review of the following detailed description and drawings, which illustrate various embodiments of the invention and are merely representations and are not necessarily drawn to scale, wherein.

DETAILED DESCRIPTION OF THE INVENTION

Generally, the drawings are merely representations employed to more clearly and fully depict the process of the invention than would otherwise be possible. The particular embodiments described hereinbelow are intended in all respects to be illustrative rather than limiting and may be incorporated into a rotary drill bit in a variety of combinations. Therefore, other and further embodiments will become apparent to those of ordinary skill in the art to which the present invention pertains without departing from its scope.

Figure 1A:
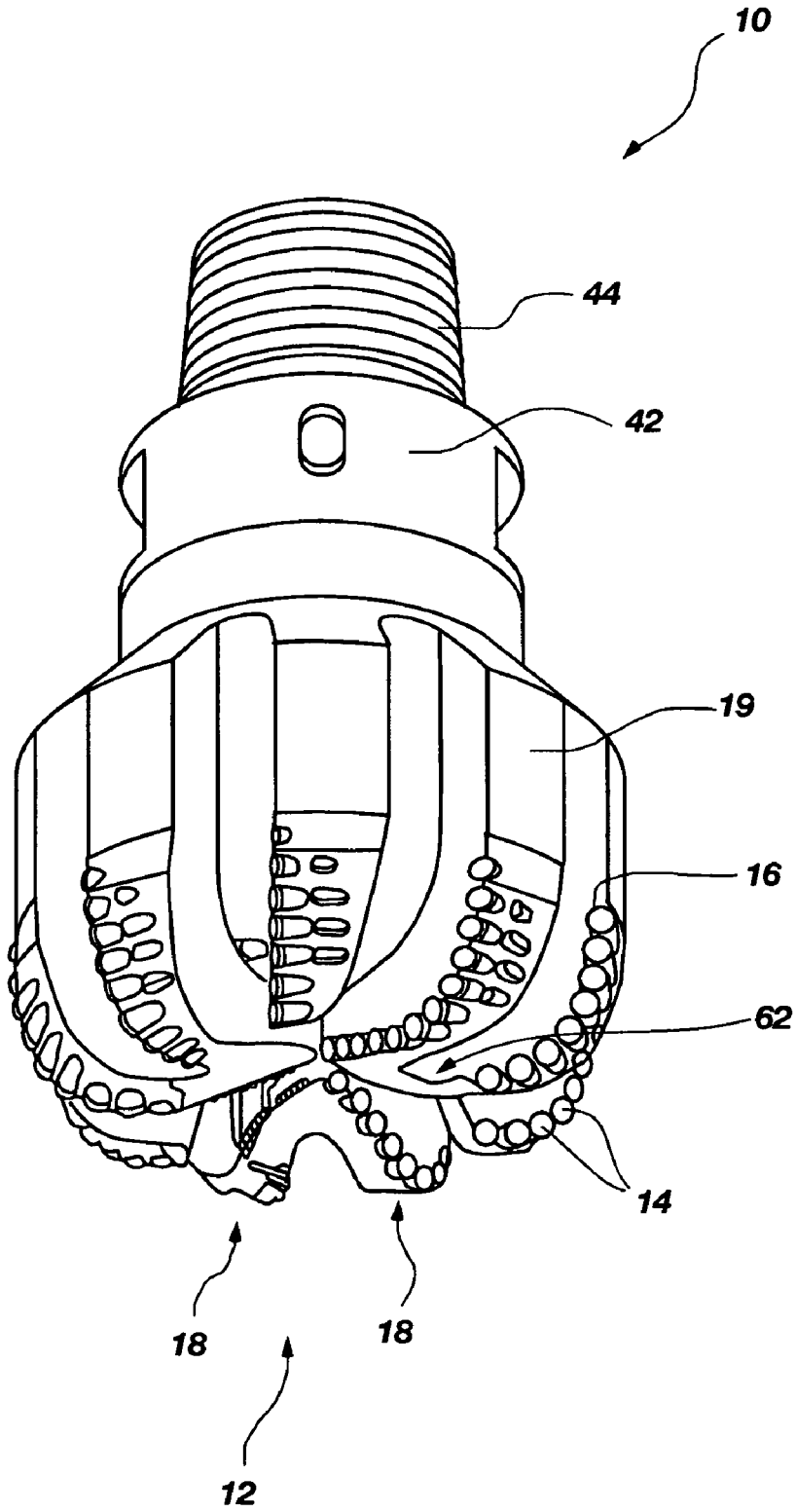
FIG. 1A shows a perspective view of a rotary drill bit according to the present invention.
Figure 1B:
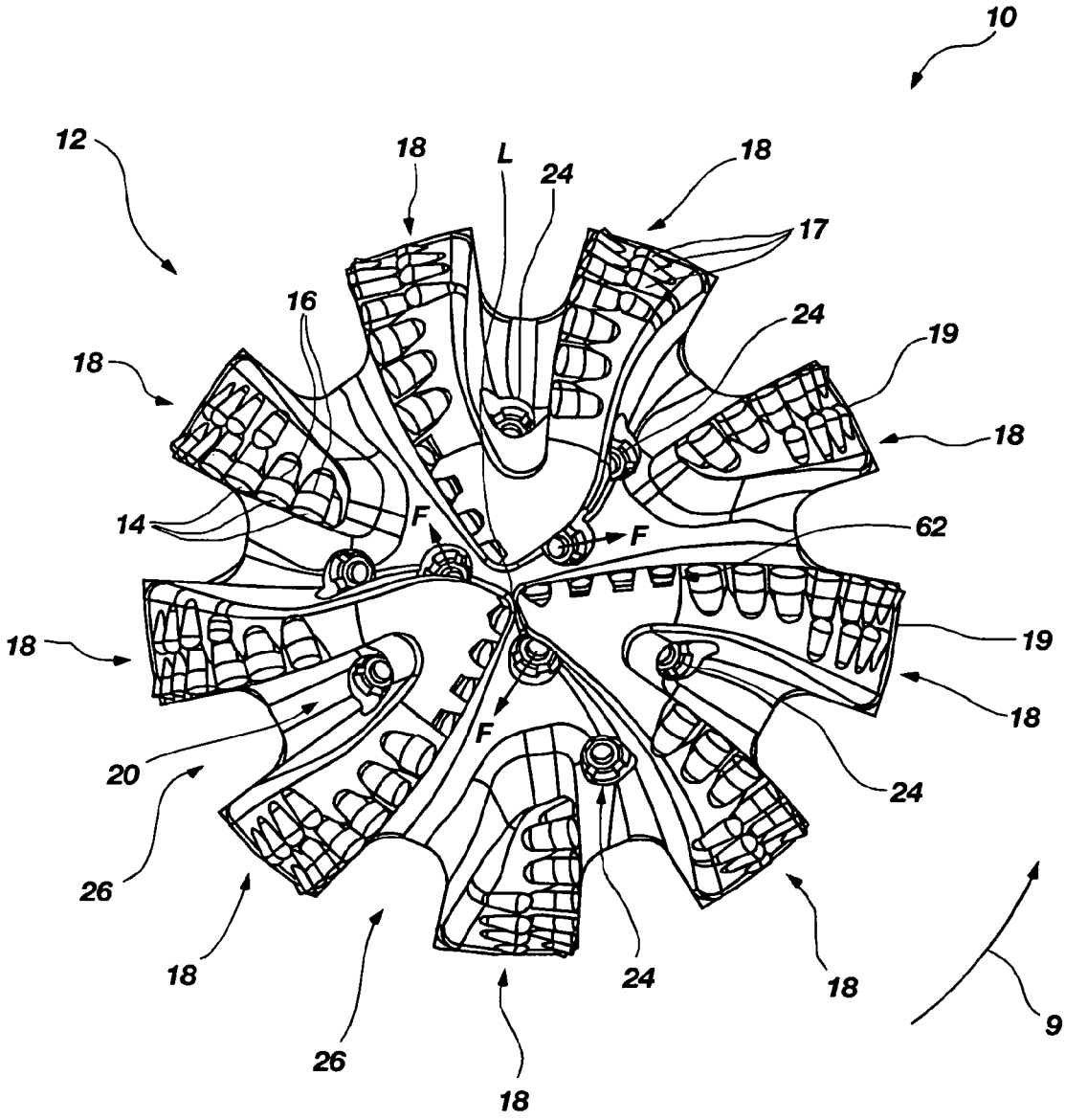
FIG. 1B shows a bottom elevation view of the rotary drill bit shown in FIG. 1A.
Figure 1C:
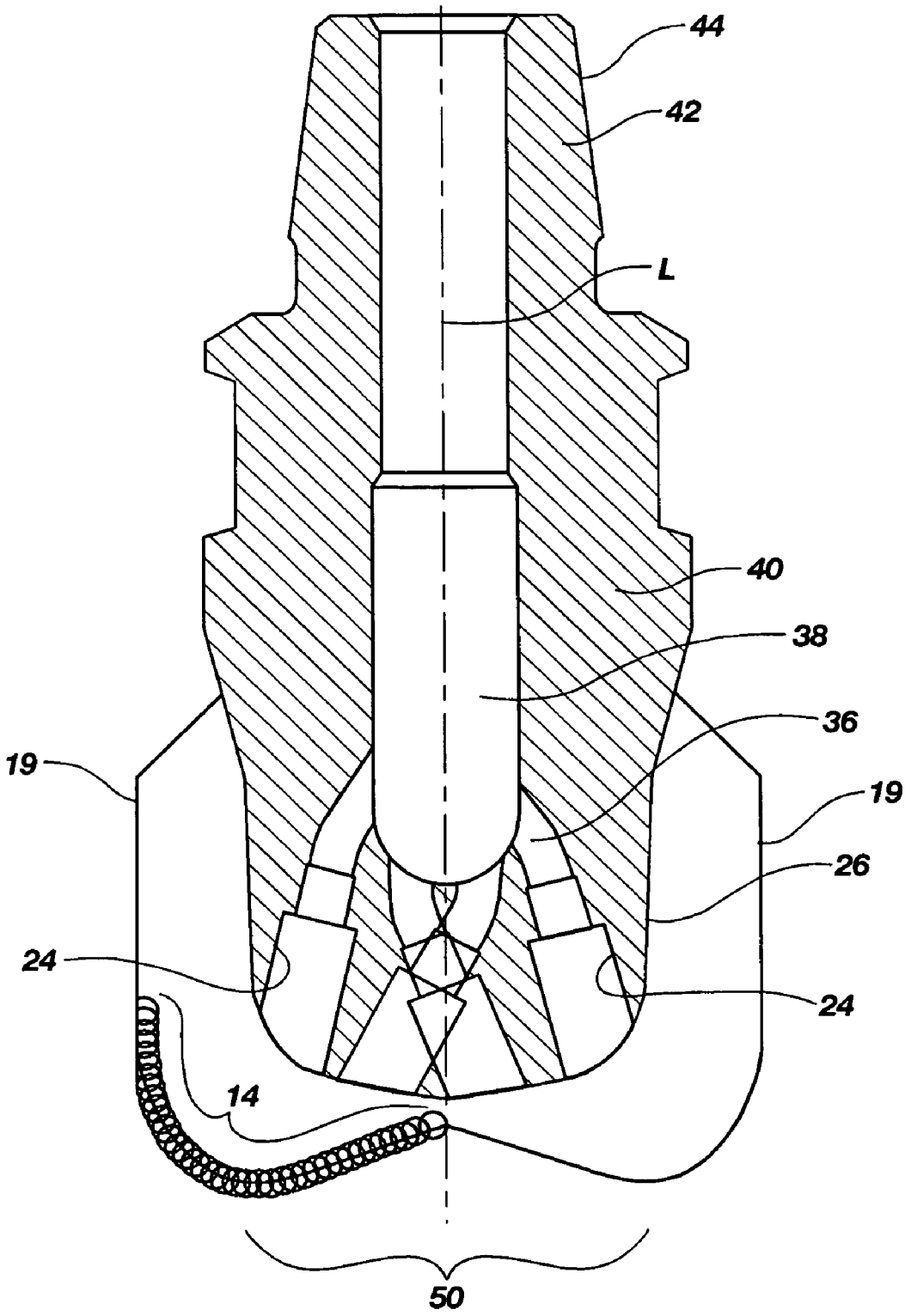
FIG. 1C shows a schematic side cross-sectional view of the rotary drill bit shown in FIGS. 1A and 1B, wherein all the cutting elements have been rotated to the viewing plane.

Referring to FIGS. 1A-1C, a rotary drill bit 10 according to the present invention will be described. Particularly, FIG. 1A of the drawings shows a perspective view of a rotary drill bit 10 according to the present invention, oriented generally as it would be for use in drilling into a subterranean formation. According to the present invention, generally, rotary drill bit 10 includes a borehole surface engagement region 62 including at least one substantially helically extending feature (not shown), aspects of which are discussed in further detail hereinbelow. As used herein "substantially helically extending" means at least generally extending along or generally corresponding to a helical path and encompasses identically extending along or identically corresponding to a helical path.

Rotary drill bit 10 may include a plurality of blades 18 generally protruding from bit body 40. More particularly, each of the plurality of blades 18 may extend generally radially outwardly (from longitudinal axis L, shown in FIG. 1C) upon the leading end or face 12 of rotary drill bit 10. Gage pads 19 comprise longitudinally upward extensions of blades 18, respectively, and may have wear resistant inserts or coatings forming at least a portion of each radially outer surface thereof, as known in the art. Further, each of the plurality of blades 18 may include cutting element pockets 16 within which cutting elements 14 (e.g., PDC cutters) may be bonded, as by brazing, as is known in the art with respect to the fabrication of fixed cutter type rotary drill bits. Alternatively, cutting elements 14 may be affixed to blades 18 of rotary drill bit 10 by way of welding, mechanical affixation, or as otherwise known in the art.

For instance, one type of fixed cutter drill bit may comprise a matrix-type drill bit including a mass of abrasion-resistant powder, such as tungsten carbide, infiltrated with a molten, subsequently hardenable binder, such as a copper-based alloy. However, the present invention is not limited to matrix-type drill bits, and other fixed cutter rotary drill bits, such as steel body drill bits, and rotary drill bits of other manufacture may also be configured according to the present invention.

Further, although FIGS. 1A-1C illustrate a fixed cutter rotary drill bit 10 including a plurality of substantially cylindrical cutting elements 14 (e.g., PDC cutting elements), the present invention is not so limited. Rather, generally, a rotary drill bit according to the present invention may include other or different cutting elements, such as, for instance, impregnated cutting structures, so-called BALLASET™ or synthetic thermally stable diamond cutting structures, or mixtures of cutting structures (e.g., PDC cutters, impregnated cutting structures, thermally stable diamond cutting structures, etc.). As discussed in more detail hereinbelow, the present invention may relate generally to any cutting elements or structures configured for creating a distinct (cut) surface of a subterranean formation in response to cutting engagement therewith.

In further detail, FIG. 1B of the drawings depicts the rotary bit 10 shown in FIG. 1A of the drawings, looking upwardly at its face 12 as if the viewer were positioned at the bottom of a borehole. Rotary drill bit 10 includes three blades 18 that extend from proximate the gage pads 19 radially inwardly therefrom to an intermediate radial position, while the other six blades 18 extend from proximate the gage pads 19 radially inwardly therefrom to a radial position proximate longitudinal axis L. In addition, blades 18 that extend proximate to one another (near the longitudinal axis L, or as otherwise positioned) may be circumferentially bridged or otherwise joined to one another within the borehole surface engagement region 62. Such a configuration may provide increased available area or space for forming at least one helically extending feature (not shown) thereon. Also, each of blades 18 may include one or more bearing elements 17 positioned for rotationally leading an associated cutting element 14.

For instance, each of the one or more bearing elements 17 may comprise a depth of cut limiting structure, depth of cut control features, or other rotationally leading formation engagement structures as known in the art, such as disclosed by U.S. Pat. No. 6,298,930 to Sinor et al. or U.S. Pat. No. 6,460,631 to Dykstra et al. Alternatively, each of the one or more bearing elements 17 may comprise a rotationally following bearing element as disclosed in U.S. Pat. No. 6,659,199 to Swadi.

During operation, rotary drill bit 10 may be affixed to a drill string (not shown), by way of threaded surface 44 of shank 42, rotated about longitudinal axis L in direction 9, and may translate along the direction of longitudinal axis L into a subterranean formation (not shown), as known in the art. Contemporaneously, drilling fluid F (shown with respect to three nozzles 24 only, for clarity) may be communicated through central plenum 38 (FIG. 1C) from the interior of rotary drill bit 10, through bit body 40, passages 36 (FIG. 1C), and nozzles 24 to the face 12 of rotary drill bit 10, moving along fluid courses 20, into junk slots 26, and ultimately upwardly within the annulus formed between the drill string and a borehole formed by the rotary drill bit 10 during drilling. Thus, as a subterranean formation is engaged and cut, formation cuttings may be swept away from the cutting elements 14 by drilling fluid F emanating from nozzles 24 moving generally radially outwardly through fluid courses 20 and then upwardly through junk slots 26 and into an annulus between the drill string from which the rotary drill bit 10 is suspended, and toward the subterranean formation surface.

FIG. 1C of the drawings shows a partial side cross-sectional view including a so-called "design" view of the cutting elements 14 positioned upon rotary drill bit 10 as shown in FIG. 1A. As is well known in the art, and as shown in FIG. 1C, rotary drill bit 10 may include a so-called inverted cone region 50, which refers generally to an indentation formed in the face 12 of the rotary drill bit 10 proximate the longitudinal axis L in a direction generally opposing the direction of drilling. Inverted cone region 50 may be generally shaped, as shown in FIG. 1C, as a generally conical or arcuate indentation which may preferably be substantially centered or symmetric about the longitudinal axis L.

As mentioned above and discussed hereinbelow, according to the present invention, the borehole surface engagement region 62 may, preferably, be positioned within the inverted cone region 50 and may include at least one substantially helically extending feature 60 (FIG. 2A) positioned upon a portion of the blades 18 within the inverted cone region 50. However, the present invention is not so limited; therefore, generally, a substantially helically extending feature according to the present invention may be positioned upon a rotary drill bit as desired and without limitation.

As background for understanding the geometry of a substantially helically extending feature of the present invention, aspects of rotary drill bit motion will be described as follows. As known in the art, a cutting element positioned on a rotary drill bit traverses along a substantially helical path during a drilling operation. The helix pitch, in terms of distance (e.g., inches, centimeters, etc.) of penetration of a rotary drill bit into a subterranean formation being drilled per each revolution of the rotary drill bit, may be characterized by the following equation:

$$\text{Helix Pitch} = \frac{ROP}{RPM}$$

Wherein:

ROP is given in units of distance per minute (e.g., feet or inches per minute);

RPM is given in units of revolutions per minute; and

Helix Pitch is given in units of distance per revolution (e.g., feet or inches per revolution).

Of course, one or more conversion factors may be employed in the above equation for calculating a Helix Pitch.

Applying the above equation to rotary drill bit 10, it may be appreciated that the Helix Pitch equals the amount of longitudinal displacement (into a subterranean formation) that each of the cutting elements 14 on the rotary drill bit 10 will exhibit during a single revolution thereof at a given (constant) ROP and RPM. However, as will be understood and appreciated by those of ordinary skill in the art, with respect to rotary drill bit 10, one of cutting elements 14 that is positioned at a radial location nearer the gage pads 19 will travel a much greater or longer circumferential distance about the longitudinal axis L of the rotary drill bit 10 than the circumferential distance traveled by another of cutting elements 14 which is located nearer to the longitudinal axis L during a single revolution of the rotary drill bit 10.

Thus, it is intuitively obvious to one of ordinary skill in the art that the slope of the substantially helical path (and corresponding depth of cut) for one of cutting elements 14 positioned proximate to the longitudinal axis L (being shorter in circumferential traversal for a given longitudinal penetration of the bit into the formation) will be substantially steeper or greater than that of the cutting element proximate to the gage pads 19 (being longer in circumferential traversal for a given longitudinal penetration of the bit into the formation). Thus, the precise substantially helical motion of each of cutting elements 14 (assuming rotary drill bit 10 rotates about longitudinal axis L) depends upon its radial position, with respect to the longitudinal axis or axis of rotation of the rotary drill bit 10, as well as both the ROP and RPM of the rotary drill bit 10 during drilling.

Thus, during drilling, each of cutting elements 14 traverses a substantially helical path as rotary drill bit 10 rotates about the longitudinal axis L. It should also be understood that, although the RPM and ROP of a rotary drill bit 10 may vary considerably during drilling, each of cutting elements 14 disposed thereon (assuming a positive ROP and a positive RPM) will traverse a substantially helical path, even though the Helix Pitch may change or vary during drilling.

Further, depending on the placement of each of cutting elements 14 with respect to one another, a portion of a periphery of each of cutting elements 14 may contact and remove a respective portion of a subterranean formation. As is known in the art and as shown in FIG. 1C, each of cutting elements 14 may be positioned so as to at least partially overlap with respect to one or more of radially adjacent cutting elements 14. The exterior or peripheral outline of the overlapping cutting elements 14 as shown in FIG. 1C, if swept about longitudinal axis L, may generally correspond to the bottomhole pattern formed into a subterranean borehole by rotary drill bit 10 while drilling on-center about longitudinal axis L. A more precise approximation or prediction of the bottomhole pattern generated via interaction of cutting elements 14 with a subterranean formation may be obtained via predictive simulations or modeling, as known in the art. Thus, during drilling, each of cutting elements 14 may create a respective portion of a borehole surface or bottomhole pattern, formed at the interface between the subterranean formation and the rotary drill bit 10, due to the portion of each of cutting elements 14 cutting edge that contacts a subterranean formation as the rotary drill bit 10 drills thereinto.

Figure 1D:
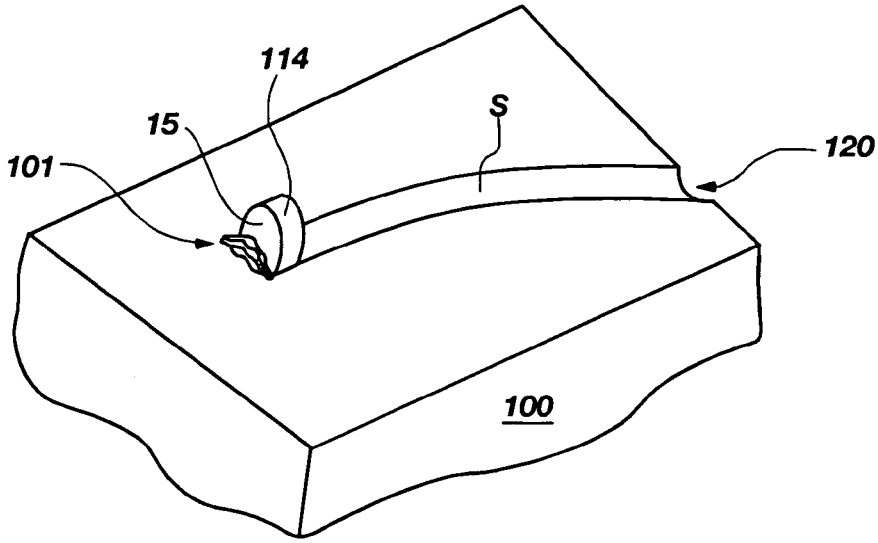
FIG. 1D shows a perspective view of a cutting element traversing a helical path while cutting a subterranean formation.

Explaining further, FIG. 1D shows a schematic, simplified perspective view of an isolated, substantially cylindrical cutting element 114 (as may be positioned upon rotary drill bit 10), cutting a distinct borehole surface S into a subterranean formation 100 by way of cutting face 15 engaging therewith and forming cuttings 101. Put another way, substantially cylindrical cutting element 114 forms a groove 120 having a surface S in response to drilling engagement between the cutting element 114 and the subterranean formation 100. A cutting envelope, as used herein, of a cutting element (such as cutting element 114) refers to the surface formed into a subterranean formation therewith. Of course, such a surface S may depend upon the rotational speed of the drill bit, the weight-on-bit, and other factors, such as the compressive strength of the subterranean formation. Further, as explained above, because cutting element 114 may follow a substantially helical path, surface S may exhibit correspondingly substantially helical aspects. Extrapolating to rotary drill bit 10, as shown in FIG. 1C, each cutting element of cutting elements 14, during drilling engagement with a subterranean formation may create an associated or distinct portion (e.g., surface S as shown in FIG. 1D) of a borehole or bottomhole surface.

Considering the aforementioned substantially helical nature of the motion of a cutting element carried by a rotary drill bit during drilling of a subterranean formation, one aspect of the present invention contemplates a rotary drill bit including a borehole surface engagement region having at least one substantially helically extending feature rotationally following an associated cutting element and exhibiting an exterior surface configured for at least partially engaging a borehole surface formed by its associated cutting element.

Figure 2A:
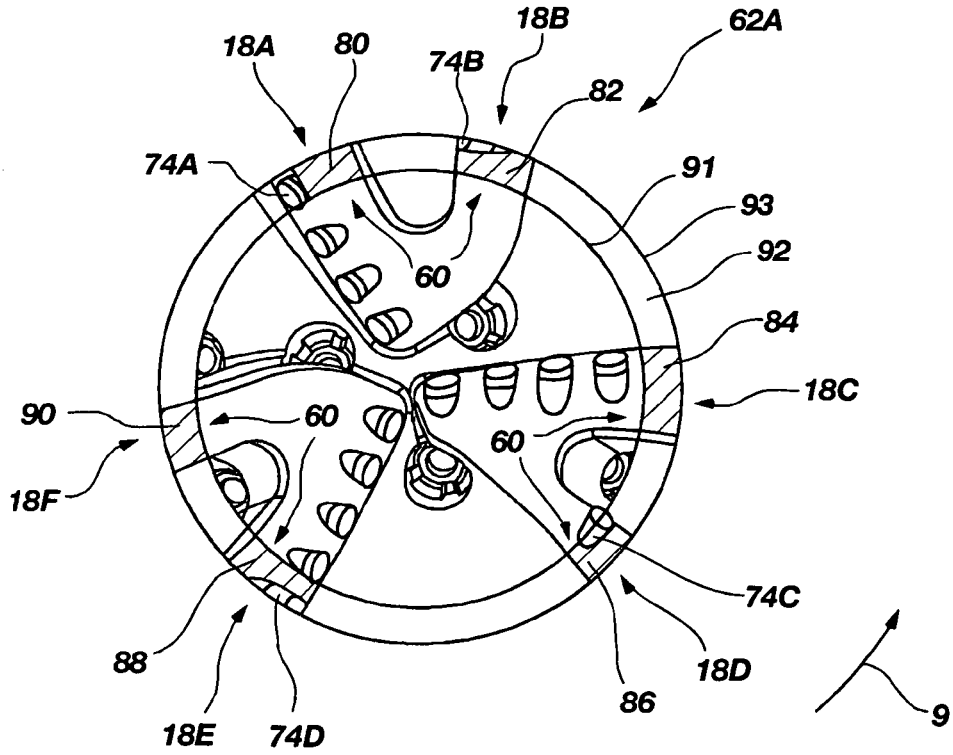
FIG. 2A shows an enlarged, partial bottom elevation view of an embodiment of a borehole surface engagement region according to the present invention.

For instance, FIG. 2A shows an enlarged, simplified, top elevation view of an exemplary embodiment of a borehole surface engagement region 62A including one substantially helically extending feature 60. Borehole surface engagement region 62A may be one embodiment of borehole surface engagement region 62 as shown in FIGS. 1A and 1B. Annulus 92, formed between radially inner circular boundary 91 and radially outer circular boundary 93 represents the cutting envelope of cutting element 74A. Thus, annulus 92 may represent a distinct portion of a borehole formed with cutting element 74A. However, annulus 92 is merely a representation, and may be exaggerated in size; an actual cutting envelope (e.g., peripheral edge contact area of cutting element 74A with a subterranean formation) of a cutting element carried by a rotary drill bit may, typically, be substantially smaller than half of the circumference thereof, as may be appreciated by review of FIGS. 1C and 1D. Substantially helically extending feature 60 is associated with cutting element 74A and is shown as occupying blade areas 80, 82, 84, 86, 88, and 90 of blades 18A, 18B, 18C, 18D, 18E and 18F, respectively. Thus, substantially helically extending feature 60 extends, rotationally following cutting element 74A, substantially helically about longitudinal axis L, longitudinally into the bit (i.e. away from the direction of drilling) at a selected Helix Pitch, circumferentially interrupted by fluid courses 20 separating circumferentially adjacent blades 18A, 18B, 18C, 18D, 18E, and 18F. Further, other blades (not shown) which do not intersect with (i.e., extend radially across) annulus 92 may be formed upon rotary drill bit 10. Put another way, helically extending feature 60 may be formed upon blades which are positioned so as to be superimposed with or intersect a helical path of helically extending feature 60.

More particularly, preferably blade area 80 may include a portion of substantially helically extending feature 60 extending from proximate the cutting edge of cutting element 74A. It may be preferable for blade area 80 to include a portion of substantially helically extending feature 60 because it immediately rotationally follows (with respect to rotation direction 9) cutting element 74A. Such a configuration may provide stabilizing contact with at least a portion of a bottomhole pattern formed by cutting element 74A into a subterranean formation during drilling. However, the present invention contemplates that substantially helically extending feature 60 may be formed within at least one blade area of blade areas 80, 82, 84, 86, 88, and 90, without limitation. Further, if substantially helically extending feature 60 is formed within a plurality of blade areas 80, 82, 84, 86, 88, and 90, substantially helically extending feature 60 may be formed within any combination of available blade areas 80, 82, 84, 86, 88, and 90.

Wear-resistant elements or inserts in the form of tungsten carbide bricks or discs, diamond grit, diamond film, natural or synthetic diamond (PDC or TSP), cubic boron nitride, a ceramic or other robust, wear-resistant material as known in the art, may form at least a portion of an exterior bearing surface of substantially helically extending feature 60 to reduce the abrasive wear thereof by contact with a subterranean formation under an applied WOB as the rotary drill bit 10 rotates under an applied torque. In lieu of inserts, at least a portion of the exterior surface of substantially helically extending feature 60 may be comprised of, or completely covered with, a wear-resistant material.

Since cutting elements 74B, 74C, and 74D rotationally follow cutting element 74A overlap with at least a portion of the annulus 92, the shape of substantially helically extending feature 60 within blade areas 82, 84, 86, 88, and 90 of blades 18B, 18C, 18D, 18E and 18F, respectively, may change in relation to the intersection or modification of the borehole surface generated by cutting element 74A by each rotationally following cutting element 74B, 74C, and 74D intersecting with annulus 92. For instance, a portion of substantially helically extending feature 60 formed within blade area 90, if any, may be modified or affected by each of cutting elements 74B, 74C, and 74D. Accordingly, the shape and size of substantially helically extending feature 60 may be adjusted in relation to or otherwise accommodate rotationally following cutting elements 74B, 74C, and 74D as they modify the portion of the borehole or bottomhole surface generated initially by cutting element 74A.

As a further contemplation of the present invention, a substantially helically extending feature of the present invention may be configured to accommodate each of a plurality of cutting elements that are positioned at substantially the same radial and longitudinal position (i.e., so-called "redundant" cutting elements), respectively. In such a configuration, each substantially helically extending feature may potentially substantially helically (circumferentially) extend to a rotationally following redundant cutting element and essentially terminate thereat.

In terms of the generally helical motion of cutting element 74A, the orientation (slope) of an exterior bearing surface of substantially helically extending feature 60 may be configured to substantially match a selected maximum slope (i.e., the Helix Pitch) of the distinct substantially helical surface cut by its associated cutting element 74A. Accordingly, substantially helically extending feature 60 may exhibit an exterior surface sized and configured in transverse cross-section and substantially helical extension so as to substantially coincide with the portion of the borehole surface formed by its associated cutting element 74A. Put another way, substantially helically extending feature 60 of a rotary drill bit 10, or of any bit according to the invention, may be of arcuate cross-section, taken transverse to the arc followed as the bit rotates, to provide an arcuate, substantially helically extending, exterior bearing surface substantially conforming to or mimicking a circumferential section of the cut surface of a portion of a borehole generated by cutting engagement of its associated cutting element 74A therewith. For example, referring back to FIG. 1D, a substantially helically extending feature may be configured so as to substantially coincide with the surface S formed by cutting element 114. Thus, substantially helically extending feature 60 may initially exhibit an arcuate exterior bearing surface substantially conforming to or mimicking the cut surface of the portion of the borehole generated by cutting engagement between a subterranean formation and its associated, unworn cutting element 74A.

As yet a further extension, a single helically extending feature associated with a cutting element may exhibit more than one Helix Pitch. For instance, referring to FIG. 2A, the Helix Pitch of helically extending feature 60 may change as it extends helically away from associated cutting element 74A. More specifically, as shown in FIG. 2A, the Helix Pitch may change within one or more blade areas 80, 82, 84, 86, 88, and 90, forming a plurality of circumferential sections of helically extending feature 60.

Thus, for example, a first circumferential section of substantially helically extending feature 60 having a first Helix Pitch may be configured for providing a first bearing surface area supporting a rotary drill bit when drilling a first compressive strength subterranean formation providing a relatively shallow Helix Pitch for the cutting element of the bit may be provided, while a second circumferential section of substantially helically extending feature 60 may remain out of contact with the subterranean formation until the Helix Pitch is sufficient to cause both the first and the second circumferential sections of substantially helically extending feature 60 to contact the subterranean formation. Thus, the first circumferential section of substantially helically extending feature 60 may be configured for indentation (failure) of the subterranean formation under applied WOB. Accordingly, indentation of the subterranean formation may occur until the second circumferential section of substantially helically extending feature 60 contacts therewith, whereupon the combined surface area of the two circumferential sections of substantially helically extending feature 60 will support the rotary drill bit 10. Of course, as mentioned above helically extending feature 60 may comprise more than two circumferential sections with respective, different Helix Pitches, without limitation.

It is also contemplated that a substantially helically extending feature 60 may be cross-sectionally structured and comprised of at least one selected material so as to intentionally and relatively quickly (in comparison to the wear rate of its associated cutting element 74A) wear from an initial exterior bearing surface to a worn exterior bearing surface that is substantially identical, but complementary to the surface of the borehole surface or portion of the bottomhole pattern formed by its associated cutting element 74A. Put another way, substantially helically extending feature 60 may include a selected sacrificial structure that is structured to wear according to the cutting envelope of its associated cutting element 74A.

Figure 2B:
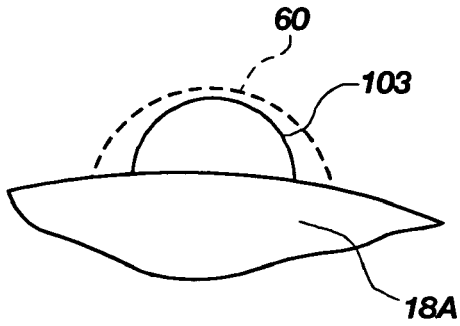
FIG. 2B shows a schematic view of a cutting envelope and a substantially helically extending feature, taken transverse to a substantially helical path of the substantially helically extending feature.

In further detail, for example, FIG. 2B shows a schematic view of a cutting envelope 103 that may be generated by cutting element 74A and the periphery of substantially helically extending feature 60, in relation to blade 18A, taken transverse to a substantially helical path of the substantially helically extending feature 60. As shown in FIG. 2B, helically extending feature 60 may exhibit a geometry that extends beyond the cutting envelope 103 (i.e., be sized so as to initially contact a subterranean formation) of cutting element 74A. Thus, initially, the helically extending feature 60 may exhibit a periphery which is larger than a cutting envelope of its associated cutting element 74A. However, helically extending feature 60 may be structured and comprised of at least one selected material so as to intentionally and relatively quickly in comparison to the wear rate of its associated cutting element (not shown) wear from its initial exterior bearing surface as shown in FIG. 2B to a worn exterior bearing surface that is substantially identical, to the cutting envelope 103 of its associated cutting element 74A.

Such a configuration may have a significant effect on the stability of a rotary drill bit, even when operating at helical pitches (i.e., depths of cut) far below the selected helical pitch at which the substantially helically extending feature contacts the formation during drilling. Explaining further, rotary drill bits may often exhibit undesirable oscillatory motion or vibrations when drilling into relatively soft rock formations (e.g., Bedford limestone, Catoosa shale, etc.). Further, such vibrations in soft rock formations may be lower in frequency and, therefore, larger in magnitude than in relatively harder rocks, which may be detrimental to a rotary drill bit drilling thereinto. However, even vibrations of relatively low magnitude in relatively hard rock formations may be substantially detrimental to a rotary drill bit, particularly if PDC cutters are installed thereon.

The inventors herein have discovered that relatively large contact surfaces provided by at least one substantially helically extending feature within the inverted cone region of a rotary drill bit may be effective in inhibiting vibrations when drilling therewith into a subterranean formation at a Helix Pitch (i.e., depth of cut) of less than the Helix Pitch of the at least one substantially helically extending feature.

Particularly, the presence of at least one substantially helically extending feature within the inverted cone region of a rotary drill bit may inhibit lateral deviation of the rotary drill bit through contact with an established on-center bottomhole surface. For instance, if the rotary drill bit is operating at a Helix Pitch (i.e., ROP or DOC at a given RPM) of less than the selected Helix Pitch exhibited by the at least one substantially helically extending feature, and if the rotary drill bit rotates about the longitudinal axis, creating an on-center bottomhole pattern, the exterior surface of the at least one substantially helically extending feature may not substantially contact the portion of the subterranean (on-center) bottomhole pattern created by its associated cutting element. However, if the rotary drill bit laterally deviates or rotates off-center subsequent to establishing such an "on-center" bottomhole pattern, the at least one substantially helically extending feature may contact at least one portion of the "on-center" bottomhole pattern, and resist such off-center rotation (lateral displacement of the rotational axis). Such a configuration may minimize removal of rock with the bit body (at least one substantially helically extending feature) during lateral deviation of the rotary drill bit during drilling because a relatively large contact area of the substantially helically extending feature may engage the bottomhole pattern. Of course, the contact area between a substantially helically extending feature and a bottomhole pattern may be selectively tailored or designed.

Additionally or alternatively, if the rotary drill bit is operating at a Helix Pitch (i.e., ROP or DOC at a given RPM) substantially equal to the selected Helix Pitch exhibited by the at least one substantially helically extending feature, the at least one substantially helically extending feature may contact the portion of the on-center bottomhole pattern generated by its associated cutting element. Of course, the contact area between a substantially helically extending feature and a bottomhole pattern may be selectively tailored or designed. Such contact may result in a large contact area between the at least one substantially helically extending feature and the bottomhole pattern, which may limit the torque response of the rotary drill bit. Further, such limiting may control so-called stick-slip torsional oscillations. In addition, such contact may substantially limit the ultimate DOC or ROP (for a given RPM) that may be attained by drilling with a rotary drill bit including the at least one substantially helically extending feature. Additional increases in WOB may be transferred to the subterranean formation through the contact area or bearing surface of the at least one substantially helically extending feature. Further, the cumulative total contact area of the at least one substantially helically extending feature may be selected in consideration of an expected maximum WOB so as to not exceed the compressive stress of the subterranean formation, as explained hereinbelow in greater detail.

Alternatively, substantially helically extending feature 60 may exhibit an exterior bearing surface which does not substantially conform to or mimic the cutting envelope or cut surface of its associated cutting element 74A. Rather, substantially helically extending feature 60 may exhibit an exterior bearing surface configured for contacting a portion of the cutting envelope or cut surface of its associated cutting element 74A. For instance, protrusions, protuberances, grooves, reliefs, or combinations thereof may form at least a portion of a substantially helically extending feature of the present invention. Such a configuration may be advantageous for tailoring the amount of bearing surface area of a borehole engagement region. Further, despite reducing the area of contact of the substantially helically extending feature 60, the aforementioned benefits of a substantially helically extending feature of the present invention may be realized to an appreciable and desirable extent.

Figure 3A:
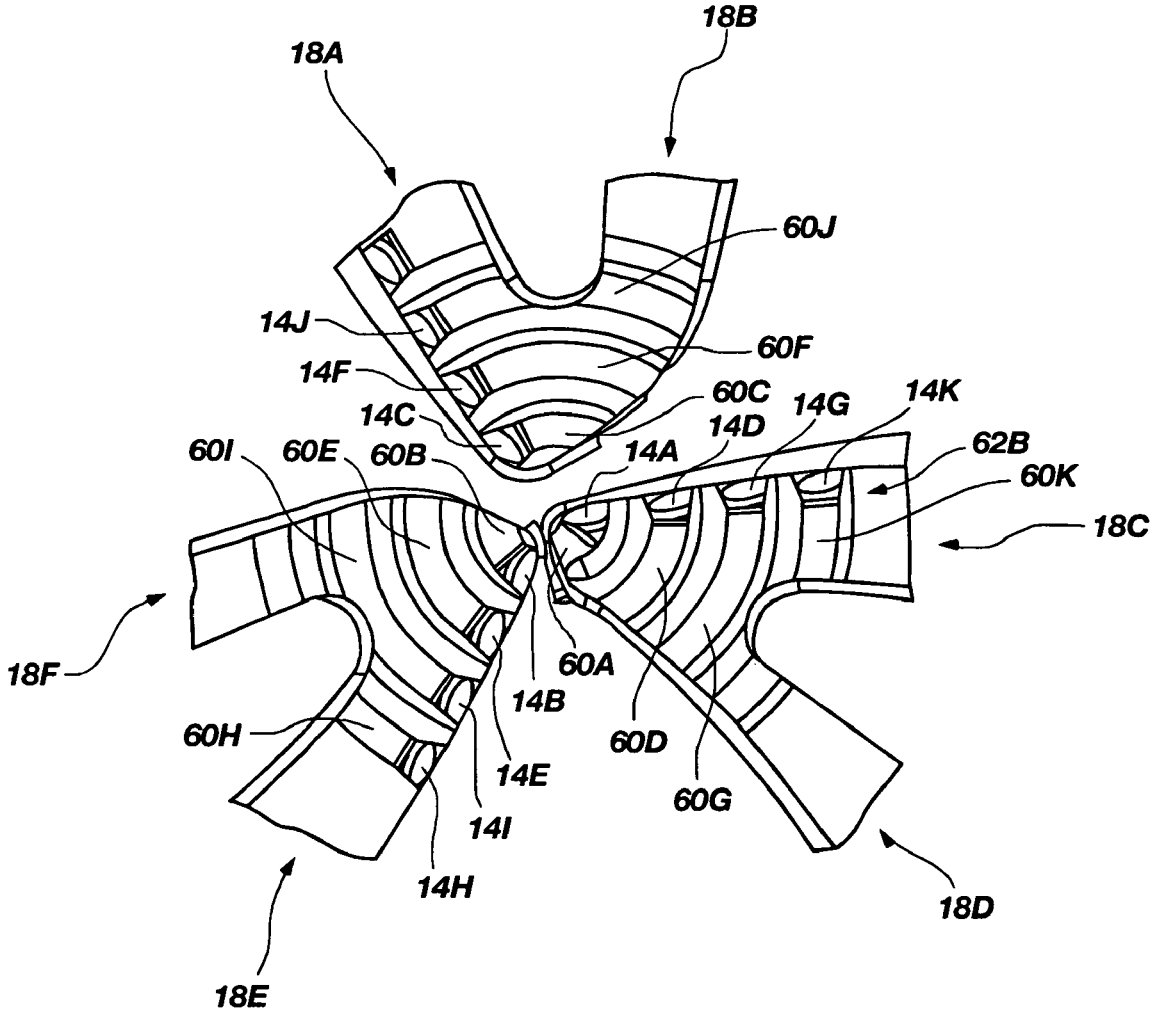
FIG. 3A shows an enlarged, partial bottom elevation view of another embodiment of a borehole surface engagement region according to the present invention.
Figure 3B:
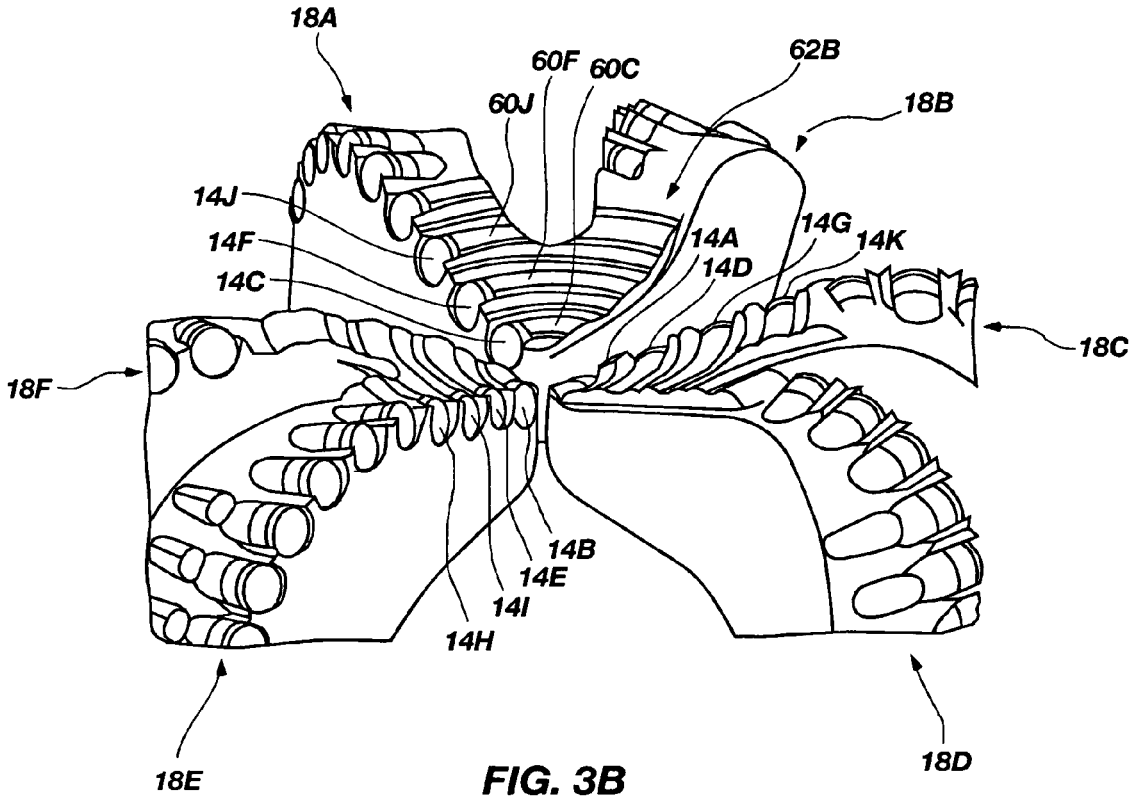
FIG. 3B an enlarged, partial perspective view of the borehole surface engagement region shown in FIG. 3A.

In another embodiment of the present invention, as shown in FIGS. 3A and 3B, borehole surface engagement region 62B may include a plurality of substantially helically extending features 60A-60K, each comprising an elongated, substantially helically extending body, residing on blades 18A-18F of rotary drill bit 10. Only substantially helically extending features 60J, 60F, and 60C, carried by blades 18A and 18B are labeled in FIG. 3B, for clarity. Borehole surface engagement region 62B is one exemplary embodiment of borehole surface engagement region 62 as shown in FIGS. 1A and 1B.

Wear-resistant elements or inserts in the form of tungsten carbide bricks or discs, diamond grit, diamond film, natural or synthetic diamond (PDC or TSP), cubic boron nitride, a ceramic or other robust, wear-resistant material as known in the art, may form at least a portion of an exterior bearing surface of at least one of substantially helically extending features 60A-60K to reduce the abrasive wear thereof by contact with a subterranean formation under an applied WOB as the rotary drill bit 10 rotates under an applied torque. In lieu of inserts, the exterior bearing surface of each of substantially helically extending features 60A-60K may be comprised of, or completely covered with, a wear-resistant material. Each of substantially helically extending features 60A-60K may extend substantially helically from proximate the leading or cutting edge of its associated cutting element of cutting elements 14A-14K, respectively. Further, in the case of a substantially cylindrical cutting element, such as a PDC cutter, each of substantially helically extending features 60A-60K may extend substantially continuously from the rotationally trailing end of each associated cutting element 14A-14K, respectively.

In one embodiment of the present invention, each of the substantially helically extending features 60A-60K may be configured with a bearing surface topography that substantially conforms to the shape of the envelope traversed by its associated cutting element (i.e., the surface cut into the formation therewith) for a given ROP and RPM (i.e., a given Helical Pitch). Put another way, the exterior of each of substantially helically extending features 60A-60K may be sized and configured for engaging substantially the entire portion of the bottomhole pattern over which each of substantially helically extending features 60A-60K is positioned (circumferentially), wherein each portion of the bottomhole pattern is formed by a respective associated cutting element of cutting elements 14A-14K at a selected ROP and RPM (i.e., a selected Helix Pitch or helical path). Therefore, in such a configuration, if the rotary drill bit 10 drills into the formation at the given ROP and RPM, substantially the cumulative or entire exterior bearing surface area of the substantially helically extending features 60A-60K may contact the bottomhole pattern substantially simultaneously.

Thus, a ROP and RPM that may cause substantially simultaneous contact of each of the substantially helically extending features 60A-60K may be conceptually understood as a maximum ROP at a minimum RPM. Therefore, it should be understood that the RPM and ROP (which is related somewhat to WOB) of a rotary drill bit may be adjusted during operation and such adjustments may produce different Helix Pitches. However, each of the substantially helically extending features 60A-60K may be sized and configured so as to not inhibit the cutting action of a respective associated cutting element 14A-14K for a Helix Pitch less than a selected maximum Helix Pitch or selected helical path.

Of course, the amount of contact area between the substantially helically extending features 60A-60K and the bottomhole pattern is influenced by the available area of the blades 18A-18F. Accordingly, as shown in FIGS. 3A and 3B, blades 18A and 18B, 18C and 18D, and 18E and 18F may be circumferentially bridged or connected so as to provide increased area for forming substantially helically extending features 60A-60K. Generally, any of blades 18A, 18B, 18C, 18D, 18E, and 18F may be bridged to one or more other of blades 18A, 18B, 18C, 18D, 18E, and 18F, respectively, as desired without limitation. Thus, extrapolating further, substantially the entire available area of the plurality of blades within an inverted cone region (e.g., inverted cone region 50 as shown in FIG. 1C) may carry substantially helically extending features associated with the cutting elements positioned therein, according to the present invention.

Further, as may be appreciated by one of ordinary skill in the art, each of the plurality of substantially helically extending features 60A-60K may be formed upon at least one of blades 18A-18F or, alternatively, a plurality of blades 18A-18F, as desired. Thus, generally, in addition to or alternative to a blade upon which the associated cutting element of a substantially helically extending feature is carried, such a substantially helically extending feature may be formed (i.e., substantially helically continued), as space allows, radially between rotationally following cutting elements carried upon one or more rotationally following blades, respectively.

For instance, considering substantially helically extending feature 60F and its associated cutting element 14F, substantially helically extending feature 60F may be formed upon, optionally, each of blades 18A-18F. Of course, it should be understood that other blades (not shown) which do not intersect with the substantially helical path of helically extending features 60F may be formed upon rotary drill bit 10. Alternatively, substantially helically extending feature 60F may be formed upon at least blade 18A and, optionally, one or more of blades 18B-18F. It may be preferable to form substantially helically extending feature 60F so as to extend circumferentially from proximate to cutting element 14F, so that the surface formed therewith during cutting of a subterranean formation may be engaged by the substantially helically extending feature 60F upon lateral displacement of the rotational axis (i.e., longitudinal axis L) or upon the Helix Pitch substantially equaling a selected Helix Pitch.

One suitable shape of one or more of substantially helically extending features 60A-60K may be a shape configured for substantially conforming to at least a portion of the cutting envelope of its associated cutting element 14A-14K. For instance, assuming that a cutting element 14A is configured as a substantially cylindrical body (such as a PDC cutter) which may be oriented at a so-called backrake angle, in the range of, for example, 5° to 35°, the cross-sectional shape of the cutting envelope (transverse to the substantially helical path thereof) of the cutting element 14A may be partially elliptical (i.e., a surface formed by a portion of an ellipse traversed along a substantially helical path), since the cylindrical edge of the cutting element 14A may likely be oriented at an negative backrake angle with respect to the (rotationally approaching) formation that it cuts, given substantially constant ROP and RPM. Backrake angle as it applies to the orientation of a cutting element 14A positioned within the rotary drill bit 10 and considerations of its generally helical motion during drilling are known in the art and such considerations may yield a so-called effective backrake angle. Thus, the cutting envelope of cutting element 14A may be determined by the shape of the cutting edge of the cutting element 14A, its effective backrake angle, and side rake angle, if any, during drilling of a subterranean formation therewith. Of course, in the event that a cutting element edge of a cutting element 14A is oriented perpendicularly to the (rotationally approaching) formation during cutting thereof, its cutting envelope thereof may be cylindrical.

Thus, substantially helically extending feature 60A may be configured in correspondence with the size and shape (e.g., partially elliptical or cylindrical) of the cutting envelope defined by cutting element 14A during cutting engagement with a subterranean formation at a selected maximum Helical Pitch or selected helical path. Explaining further, each of substantially helically extending features 60A-60K may be of arcuate cross-section, taken transverse to the substantially helical arc followed by a cutting element as rotary drill bit 10 rotates about its longitudinal axis L, to provide substantially helically extending features 60A-60K, each of which substantially replicates the surface of the formation as it is cut by an unworn, associated cutting element 14A-14K. Put another way, each of substantially helically extending features 60A-60K may be configured for substantially mating against a portion of the formation generated by its rotationally preceding cutting element 14A-14K for a selected maximum Helix Pitch or selected helical path (i.e., a selected maximum ROP at a selected minimum RPM). Of course, alternatively, a substantially helically extending feature of the present invention may be configured so as to wear in response to contact with a subterranean formation to form an exterior surface that substantially replicates the surface of the formation as it is cut by its associated cutting element, as discussed in further detail hereinbelow.

In a further alternative, one or more of substantially helically extending features 60A-60K may exhibit an exterior bearing surface which does not substantially conform to or mimic the cutting envelope or cut surface of its associated cutting element 14A-14K, respectively. Rather, one or more of substantially helically extending features 60A-60K may exhibit an exterior bearing surface configured for contacting a portion of the cutting envelope or cut surface of its associated cutting element 14A-14K, respectively. Such a configuration may be advantageous for tailoring the amount of bearing surface area of a borehole engagement region. Further, tailoring the area of contact of substantially helically extending features 60A-60K may allow for selective tailoring of the aforementioned benefits of a substantially helically extending feature of the present invention in view of other desired performance or operational characteristics.

Thus, substantially helically extending features 60A-60K may each exhibit an exterior bearing surface configured for contacting only a portion of the borehole surface or bottomhole surface generated by its associated cutting element 14A-14K, respectively. Such a configuration may be advantageous for tailoring the amount of bearing surface area of a borehole engagement region in relation to a compressive strength of a subterranean formation, as discussed hereinbelow.

Further, the cumulative contact area of substantially helically extending features 60A-60K may provide sufficient surface area to withstand the longitudinal WOB or, additionally or alternatively, lateral displacement without exceeding the compressive strength of the formation being drilled, so that the rock does not indent or fail and the penetration (ROP) or lateral displacement (off-center rotation) of cutting elements 14A-14K into the rock may be substantially controlled.

By way of example only, the total surface area of substantially helically extending features configured for contacting a subterranean formation at a selected maximum Helix Pitch for rotary drill bit 10 generally configured as shown in FIG. 2A may be about 10 square inches. If, for example, the unconfined compressive strength of a relatively soft formation to be drilled by rotary drill bit 10 is 3,000 pounds per square inch (psi), then at least about 30,000 lbs. WOB may be applied without failing or indenting the formation. Such WOB may be far in excess of the WOB which may normally be applied to a bit in such formations (for example, as little as 2,000 to 4,000 lbs., up to about 6,000 lbs.). In harder formations, with, for example, 20,000 to 40,000 psi compressive strengths, the total surface area of the substantially helically extending features may be significantly reduced while still accommodating a substantial range of WOB applied to keep the bit firmly on the borehole bottom. Of course, a total surface area of the substantially helically extending features may be designed with respect to a compressive strength of a subterranean formation and may preferably provide for an adequate "margin" of excess bearing area in recognition of variations in compressive strength of a subterranean formation due to formation changes and pressure effects (pore pressure, overburden pressure, etc.) or to preclude substantial indentation and failure of the formation downhole.

Similarly, the total surface contact area of substantially helically extending features carried by a rotary drill bit may be configured for contacting an established on-center borehole or bottomhole pattern at a stress less than the compressive stress of the subterranean formation, in response to an anticipated lateral deviation of the rotational axis. More particularly, for a relatively low magnitude of lateral deviation of the rotational axis, the total surface contact area of the substantially helically extending features with an established on-center bottom hole pattern may be sized and configured as sufficient to inhibit further indentation (i.e., further lateral displacement) into the subterranean formation. Of course, initial amounts of lateral deviation may cause indentation or stresses exceeding the compressive strength of the subterranean formation, but substantially helically extending features may be configured for contacting the formation at increasingly greater contact areas in relation to increasing lateral deviation; thus, quickly inhibiting or limiting additional lateral deviation.

With respect to design of a rotary drill bit including a plurality of substantially helically extending features having a cumulative contact area for withstanding a longitudinal WOB or, additionally or alternatively, lateral displacement without exceeding the compressive strength of the formation being contacted, simulation or modeling of a rotary drill bit may be employed. For instance, considering lateral displacement of a rotary drill bit, an on-center bottomhole pattern may be simulated and the contact area between a plurality of substantially helically extending features and the on-center bottomhole pattern may be predicted or simulated. Thus, the amount of contact area in relationship to an anticipated lateral deviation of the rotational axis of a rotary drill bit may be predicted, selected or designed, or combinations thereof.

Cutting elements 14A-14K may comprise PDC cutters, which, as known in the art, may be configured with chamfers, so-called buttresses, or combinations thereof. One exemplary type of PDC cutter which may comprise one or more of cutting elements 14A-14K, may be a so-called carbide-supported-edge (CSE) PDC cutter in accordance with U.S. Pat. No. 5,460,233. Such a PDC cutter may, optionally, further include a relatively large bevel, or rake land, on the diamond table in accordance with U.S. Pat. No. 5,706,906 and related U.S. Pat. No. 6,000,483. Each of the three foregoing patents is assigned to the assignee of the present invention and is hereby incorporated by reference herein. Another exemplary type of PDC cutter which may comprise one or more of cutting elements 14A-14K, may be a so-called diamond-supported-edge (DSE) PDC cutter, having a relatively thick diamond table and a relatively generous chamfer, as known in the art.

In the case of matrix-type bits, by way of example and not limitation, substantially helically extending features 60A-60K may be formed of protrusions of the infiltrated matrix material of the bit body 40 extending into cavities formed on the interior surface of the bit mold cavity which defines the exterior shape of the bit body 40. The wear-resistance of the substantially helically extending features 60A-60K may be augmented, by way of example only, by placing diamond grit within the matrix material adjacent the outer surface of the substantially helically extending features 60A-60K prior to infiltration of the bit body 40.

Alternatively, by way of example and not limitation, in the case of steel body bits, the elongated bearing elements may be formed from a hardfacing material applied to a steel body. The use of hardfacing to form wear knots on bit bodies is disclosed and claimed in U.S. Pat. No. 6,651,756 to Costo et al., assigned to the assignee of the present invention, the disclosure of which is incorporated, in its entirety, by reference herein. Hardfacing may generally include some form of hard particles delivered to a surface via a welding delivery system. Hard particles may come from the following group of cast or sintered carbides including at least one of chromium, molybdenum, niobium, tantalum, titanium, tungsten, and vanadium and alloys and mixtures thereof. U.S. Pat. No. 5,663,512 to Schader et al., assigned to the assignee of the present invention and the disclosure of which is incorporated, in its entirety, by reference herein discloses hard particles for hardfacing applications. Commonly, sintered, macrocrystalline, or cast tungsten carbide particles are captured within a mild steel tube. The steel tube containing the tungsten carbide mixture is then used as a welding rod to deposit hardfacing onto the desired surface, usually in the presence of a deoxidizer, or flux material, as known in the art. The shape, size, and relative percentage of different hard particles may affect the wear and toughness properties of the deposited hardfacing, as described by Schader et al. Additionally, U.S. Pat. No. 5,492,186 to Overstreet, assigned to the assignee of the present invention and the disclosure of which is incorporated by reference herein, describes a hardfacing configuration for heel row teeth on a roller cone drill bit. Thus, the characteristics of hardfacing may be customized to suit the purposes of each of the plurality of substantially helically extending features 60A-60K formed therewith.

In yet a further alternative, helically extending features 60A-60K may be fabricated separately by way of infiltration, hot pressing, machining, or as otherwise known in the art. Further, such separately fabricated helically extending features 60A-60K may be affixed to rotary drill bit 10 by mechanical affixation techniques as known in the art, for instance, brazing, threaded fasteners, welding, etc. Such a configuration may be advantageous for providing a mechanism for tailoring the helically extending features 60A-60K to an expected subterranean formation to be drilled.

Accordingly, another consideration in the design of bits according to the present invention relates to the abrasivity of the formation being drilled, and relative wear rates of the substantially helically extending features 60A-60K and the cutting elements 14A-14K. In non-abrasive formations such a consideration is not of major concern, as neither the substantially helically extending features 60A-60K nor the cutting elements 14A-14K will wear appreciably. However, in more abrasive formations, it may be necessary to provide wear inserts, hardfacing, or otherwise protect the substantially helically extending features 60A-60K against excessive (i.e., premature) wear in relation to the cutting elements 14A-14K with which they are associated, respectively.

It is also contemplated that two different Helix Pitch values (i.e., different helical paths) may be selected for different substantially helically extending features employed on a bit. For instance, a first plurality of substantially helically extending features may be configured for providing a first bearing surface area supporting a rotary drill bit when drilling a harder, higher compressive strength subterranean formation providing a relatively shallow Helix Pitch for the cutting element of the bit may be provided, while a second plurality of substantially helically extending features may remain out of contact with the subterranean formation until the Helix Pitch is sufficient (e.g., within a lower compressive stress subterranean formation) to cause both the first and the second pluralities of substantially helically extending features to contact the subterranean formation. Thus, the first plurality of substantially helically extending features may be configured for indentation (failure) of the subterranean formation under applied WOB. Accordingly, indentation of the subterranean formation may occur until the second plurality of substantially helically extending features contacts therewith, whereupon the combined surface area of the two pluralities of substantially helically extending features will support the rotary drill bit.

In another aspect of the present invention, as noted above, the borehole surface engagement region 62 including at least one substantially helically extending feature may be formed generally within the inverted cone region 50 of the rotary drill bit 10, proximate to the longitudinal axis or center of the rotary drill bit 10. Such a configuration may be advantageous for inhibiting off-center rotation of the rotary drill bit 10 during drilling by anchoring the inverted cone region 50. As mentioned above, if the rotary drill bit 10 laterally deviates or rotates off-center subsequent to establishing an "on-center" bottomhole pattern, the plurality of substantially helically extending features 60A-60K may contact portions of the "on-center" bottomhole pattern, and resist such off-center rotation (lateral displacement of the rotational axis).

Figure 4:
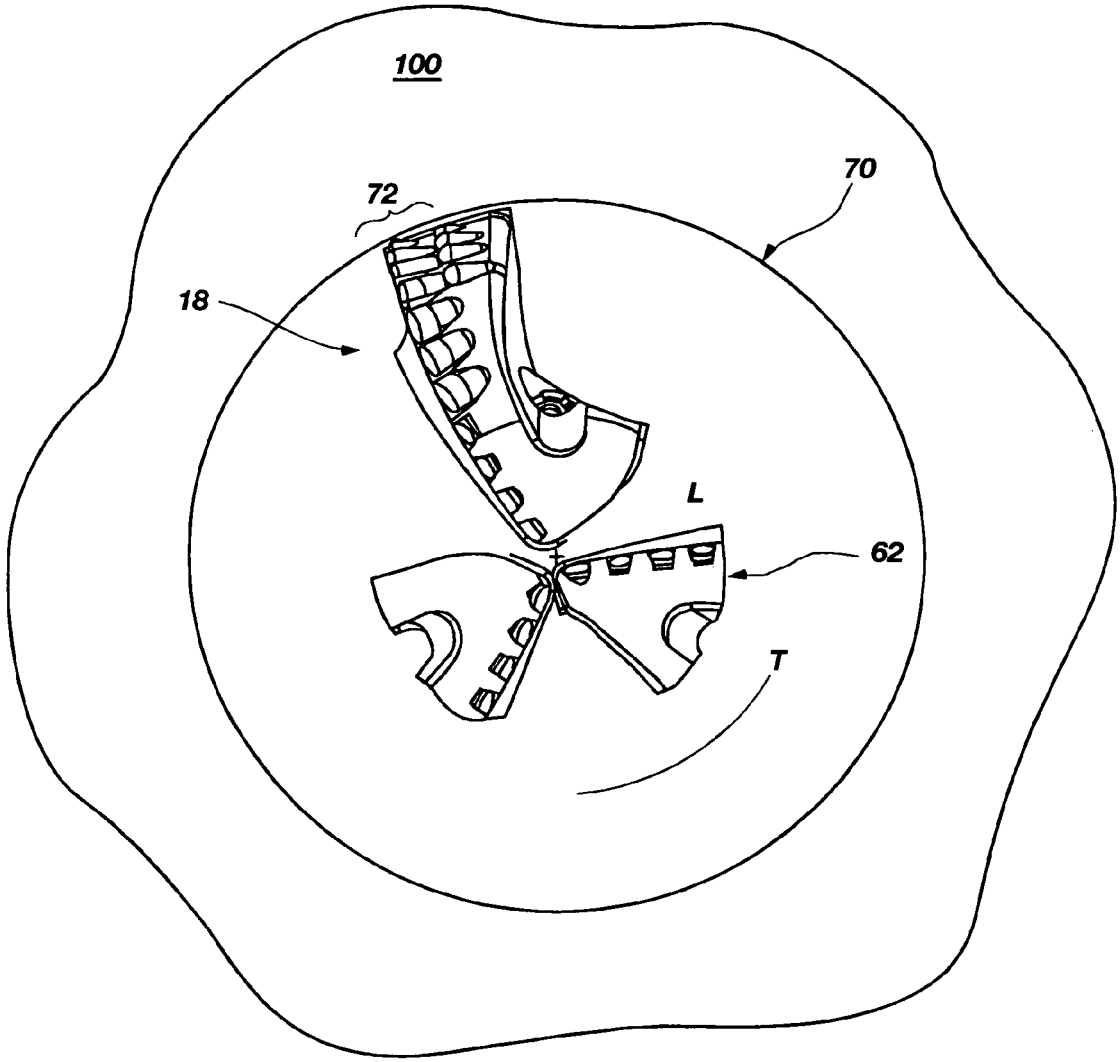
FIG. 4 shows a schematic partial bottom elevation view of a rotary drill bit of the present invention.

For example, FIG. 4 shows a single blade 18 of rotary drill bit 10 positioned within a borehole 70 formed in subterranean formation 100. Assuming that blade 18 becomes displaced into borehole 70, causing the cutting elements 14 thereon to "dig into" or gouge the subterranean formation 100 within or near region 72, the longitudinal axis L of the rotary drill bit 10 may attempt to rotate about region 72. That is, the rotary drill bit 10 may rotate about the periphery of the borehole 70, which may be slightly oversized. Such a rotational motion may be termed "whirling" behavior, which may be extremely deleterious to cutting elements 14 as well as other structures of the rotary drill bit 10.

Accordingly, the borehole surface engagement region 62 may resist rotation about region 72. More specifically, if the rotary drill bit 10 laterally deviates or rotates off-center subsequent to establishing an "on-center" bottomhole pattern, the borehole surface engagement region 62 may contact the established on-center bottomhole pattern, thus inhibiting or anchoring the region proximate the center (i.e., the radial position of the longitudinal axis) of the rotary drill bit 10. Such contact may advantageously limit or inhibit vibration of the rotary drill bit 10 as it drills into subterranean formation 100.

Furthermore, as explained above, under a relatively small, selected lateral displacement of the longitudinal axis L of rotary drill bit 10, the contact area of the borehole surface engagement region 62 (for a given, selected amount of lateral deviation) may be of sufficient size so as to contact the borehole surface at a stress not exceeding the compressive stress of the subterranean formation. More particularly, the contact area of the borehole surface engagement region 62 (for a given, selected amount of lateral deviation) may be of sufficient size so as to resist a torque not exceeding a maximum torque T applied to the rotary drill bit 10 while contacting the on-center bottomhole pattern at a stress not exceeding the compressive stress of the subterranean formation. Such a configuration may be advantageous for limiting the lateral deviation of the rotary drill bit 10 and, optionally, maintaining the shape of the on-center borehole surface. Thus, the stability of a rotary drill bit 10 may be enhanced by forming borehole surface engagement region 62 having a plurality of substantially helically extending features exhibiting a sufficient size so as to contact and anchor the borehole surface at a stress not exceeding the compressive stress of the subterranean formation 100.

Limitation of vibration and off-center rotation may be highly desirable, even considering that substantially helically extending features may impede the ultimate ROP (for a given RPM) of a drill bit so equipped. However, substantially helically extending features may achieve a predictable and substantially sustainable Helix Pitch in conjunction with a known ability of a bit's hydraulics to clear formation cuttings from the bit at a given maximum volumetric rate, a sustainable maximum Helix Pitch may be achieved without bit balling and enhance drilling stability with resulting reduced cutter wear and substantial elimination of cutter damage and breakage from instability or excessive DOC. Further motor stalling, loss of tool face, and torsional oscillations (e.g., stick-slip type torsional behavior) may also be eliminated. Thus, the ability to damp out vibrations and bounce by maintaining the bit in constant contact with the formation may be highly beneficial in terms of bit stability and longevity, while in steerable applications the invention may preclude loss of tool face.

Although specific embodiments have been shown by way of example in the drawings and have been described in detail herein, the invention may be susceptible to various modifications, combinations, and alternative forms. Therefore, it should be understood that the invention is not intended to be limited to the particular forms disclosed. Rather, the invention includes all modifications, equivalents, combinations, and alternatives falling within the spirit and scope of the invention as defined by the following appended claims.

What is claimed is:

1. A rotary drill bit for subterranean drilling, comprising:

a bit body including a leading end for contacting a formation during drilling and a trailing end having a connection structure associated therewith for connecting the rotary drill bit to a drill string;

at least one cutting element affixed to the leading end and configured to form a distinct borehole surface in response to drilling engagement with a subterranean formation; and at least one substantially helically extending feature associated with the at least one cutting element and rotationally following the at least one cutting element;

wherein the at least one substantially helically extending feature is structured for contacting at least a portion of the distinct borehole surface generated by the at least one cutting element while engaging the subterranean formation along a predetermined, selected helical path.

2. The rotary drill bit of claim 1, wherein the at least one substantially helically extending feature is positioned within an inverted cone region of the rotary drill bit.

3. The rotary drill bit of claim 1, wherein the at least one substantially helically extending feature exhibits an exterior surface area for substantially completely contacting the distinct borehole surface along its circumferential length for the selected helical path of the at least one cutting element.

4. The rotary drill bit of claim 1, wherein the at least one substantially helically extending feature comprises a plurality of circumferential sections having different helix pitches, respectively.

5. The rotary drill bit of claim 1, further comprising:

a plurality of blades formed upon the bit body; and at least another cutting element affixed to the leading end, wherein the at least one cutting element and the at least another cutting element form a plurality of cutting elements; and wherein each of the plurality of blades carries at least one of the plurality of cutting elements.

6. The rotary drill bit of claim 5, wherein the at least one substantially helically extending feature is formed upon more than one blade of the plurality of blades.

7. The rotary drill bit of claim 6, wherein the at least one substantially helically extending feature exhibits an exterior surface area extending from substantially the associated at least one cutting element carried by one blade of the plurality of blades over at least two blades of the plurality of blades.

8. The rotary drill bit of claim 6, wherein the at least one substantially helically extending feature is formed upon each blade of the plurality of blades positioned so as to intersect with a substantially helical path of the at least one substantially helically extending feature.

9. The rotary drill bit of claim 8, wherein the at least one substantially helically extending feature is modified by the at least another cutting element of the plurality of cutting elements that rotationally follows the associated at least one cutting element.

10. The rotary drill bit of claim 5, wherein the at least one substantially helically extending feature comprises a plurality of substantially helically extending features, each formed upon at least one of the plurality of blades and associated with a respective cutting element of the plurality of cutting elements and rotationally following with respect thereto.

11. The rotary drill bit of claim 10, wherein each of the plurality of substantially helically extending features is formed upon more than one blade of the plurality of blades.

12. The rotary drill bit of claim 11, wherein at least two blades of the plurality of blades are bridged to one another and at least one of the plurality of substantially helically extending features is formed upon the bridged portion between the at least two blades of the plurality of blades.

13. The rotary drill bit of claim 10, wherein the plurality of substantially helically extending features exhibits, cumulatively, an exterior surface area for substantially completely contacting, with the portion over which the plurality of substantially helically extending features are formed, a bottomhole pattern formed by drilling engagement of the rotary drill bit with the subterranean formation at the selected helical pitch.

14. The rotary drill bit of claim 10, wherein each of the plurality of substantially helically extending features is positioned within an inverted cone region of the rotary drill bit.

15. The rotary drill bit of claim 10, wherein the plurality of substantially helically extending features is configured for substantially simultaneously contacting a bottomhole pattern formed by drilling engagement between the plurality of cutting elements and the subterranean formation at the selected helical pitch.

16. The rotary drill bit of claim 5, wherein the plurality of cutting elements comprises a plurality of PDC cutters.

17. The rotary drill bit of claim 16, wherein at least some of the plurality of PDC cutters include at least one of a chamfer and a buttress.

18. The rotary drill bit of claim 16, wherein at least some of the plurality of PDC cutters comprise at least one of carbide-supported-edge PDC cutters and diamond-supported-edge PDC cutters.

19. The rotary drill bit of claim 16, wherein each of the plurality of PDC cutters is oriented at a backrake angle of between 50 and 35°.

20. The rotary drill bit of claim 1, wherein the at least one substantially helically extending feature exhibits an arcuate cross-section, taken transverse to its direction of helical extension.

21. The rotary drill bit of claim 20, wherein the at least one substantially helically extending feature exhibits an arcuate cross-sectional periphery, taken transverse to the helical extension thereof which is larger than a cutting envelope of the at least one cutting element associated therewith.

22. The rotary drill bit of claim 20, wherein the at least one substantially helically extending feature exhibits an at least partially elliptical or at least partially cylindrical cross-section, taken transverse to its direction of helical extension.

23. The rotary drill bit of claim 1, wherein the at least one cutting element comprises a plurality of cutting elements.

24. The rotary drill bit of claim 23, wherein the at least one substantially helically extending feature comprises a plurality of substantially helically extending features each associated with a respective cutting element of the plurality of cutting elements and rotationally following with respect thereto.

25. The rotary drill bit of claim 24, wherein the plurality of substantially helically extending features exhibits, in total, a surface area sufficient, when engaged with the formation under a selected helix pitch, to prevent compressive failure of the subterranean formation in contact therewith.

26. The rotary drill bit of claim 24, wherein the plurality of substantially helically extending features exhibits, in total, a surface area sufficient, when engaged with an established on-center bottomhole pattern at a selected amount of lateral displacement, to prevent compressive failure of a formation material in contact therewith.

27. The rotary drill bit of claim 24, wherein bearing surfaces of at least some of the plurality of substantially helically extending features exhibit a first helix pitch and at least others of the plurality of substantially helically extending features exhibit a second, different helix pitch.

28. The rotary drill bit of claim 23, wherein the plurality of cutting elements comprises a plurality of redundant cutting elements and the at least one substantially helically extending feature comprises a plurality of substantially helically extending features, each associated with one of the plurality of redundant cutting elements.

29. The rotary drill bit of claim 1, wherein at least a portion of an exterior surface of the at least one substantially helically extending feature comprises at least one wear-resistant structure.

30. The rotary drill bit of claim 29, wherein the at least one wear-resistant structure comprises at least one of tungsten carbide, thermally stable polycrystalline diamond, natural diamond, diamond grit, diamond film, and cubic boron nitride.

31. The rotary drill bit of claim 29, wherein the at least one wear-resistant structure comprises hardfacing.

32. A method of operating a rotary drill bit for subterranean drilling, comprising:

providing a rotary drill bit having at least one cutting element, a longitudinal axis, and at least one substantially helically extending feature associated with the at least one cutting element;

drilling into a subterranean formation with the rotary drill bit to form a borehole having an on-center bottomhole pattern within the subterranean formation; and contacting at least a portion of the on-center bottomhole pattern with the at least one substantially helically extending feature in response to a lateral deviation of the longitudinal axis of the rotary drill bit.

33. The method of claim 32, wherein contacting at least a portion of the on-center bottomhole pattern with the at least one substantially helically extending feature comprises reducing vibration of the rotary drill bit while drilling into the subterranean formation.

34. The method of claim 32, wherein contacting at least a portion of the on-center bottomhole pattern with the at least one substantially helically extending feature comprises limiting the lateral deviation of the longitudinal axis of the rotary drill bit.

35. The method of claim 34, wherein limiting the lateral deviation of the longitudinal axis of the rotary drill bit comprises resisting a torque applied to the rotary drill bit.

36. The method of claim 32, wherein contacting at least a portion of the on-center bottomhole pattern with the at least one substantially helically extending feature comprises contacting the at least a portion of the on-center bottomhole pattern with the at least one substantially helically extending feature at a unit stress of less than a compressive stress of the subterranean formation.

37. The method of claim 36, wherein contacting at least a portion of the on-center bottomhole pattern with the at least one substantially helically extending feature comprises limiting the lateral deviation of the longitudinal axis by resisting a torque applied to the rotary drill bit.

38. The method of claim 32, wherein the at least one substantially helically extending feature has a selected helical pitch.

39. The method of claim 38, further comprising contacting the subterranean formation with the at least one substantially helically extending feature in response to the rotary drill bit drilling at substantially the selected helical pitch.

40. The method of claim 32, wherein contacting at least a portion of the on-center bottomhole pattern with the at least one substantially helically extending feature in response to a lateral deviation of the longitudinal axis of the rotary drill bit comprises contacting the at least a portion of the on-center bottomhole pattern with a plurality of substantially helically extending features in response to the lateral deviation of the longitudinal axis of the rotary drill bit.

* * * * *